US009435601B2

(12) United States Patent
Poling

(10) Patent No.: US 9,435,601 B2
(45) **Date of Patent: *Sep. 6, 2016**

(54) BIPOD LEG MOUNTING BODY AND BIPOD COMPRISING SAME

(71) Applicant: Dale Avery Poling, Potomac, MT (US)

(72) Inventor: Dale Avery Poling, Potomac, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/508,490

(22) Filed: Oct. 7, 2014

(65) Prior Publication Data

US 2015/0135577 A1 May 21, 2015

Related U.S. Application Data

(63) Continuation of application No. 13/784,773, filed on Mar. 4, 2013, now Pat. No. 8,863,430, which is a continuation-in-part of application No. 12/930,574, filed on Jan. 11, 2011, now Pat. No. 8,443,540.

(51) Int. Cl.
*F41A 23/08* (2006.01)
*F41A 23/10* (2006.01)

(52) U.S. Cl.
CPC ..... *F41A 23/08* (2013.01); *F41A 23/10* (2013.01)

(58) Field of Classification Search
CPC ..... F41A 23/10; F41A 23/08; F41A 23/06; F41A 23/00; F41G 11/004; F41G 1/44; F16M 13/00; F16M 11/24; F16M 11/245; F16M 11/36; F16M 2200/08; F16M 11/04; F16M 11/126; F16M 11/16; F16M 11/2092; F16M 13/022; F16M 11/32; F16M 11/041; F16M 11/10; F16M 11/242; F16M 11/2078; F16M 11/42; F16M 11/06; F16M 11/2071; F16M 13/005; F16M 13/04; G03B 17/56; G03B 17/561
USPC ..... 42/94; 89/37.04, 37.05; 248/163.1, 248/163.2
See application file for complete search history.

(56) References Cited

U.S. PATENT DOCUMENTS

| | | | | |
|---|---|---|---|---|
| 1,441,285 | A * | 1/1923 | Johnston | F41A 23/08 42/94 |
| 1,580,406 | A * | 4/1926 | Browning | F41A 23/08 42/94 |
| 2,807,904 | A * | 10/1957 | Kreske | F41A 23/08 42/94 |
| 4,625,620 | A * | 12/1986 | Harris | F41A 23/08 42/94 |
| 7,478,496 | B2 * | 1/2009 | Bender | F41A 23/10 248/176.1 |
| 8,443,540 | B2 * | 5/2013 | Poling | 42/94 |
| 8,863,430 | B2 * | 10/2014 | Poling | 42/94 |

* cited by examiner

*Primary Examiner* — Troy Chambers
*Assistant Examiner* — Bridget Cochran
(74) *Attorney, Agent, or Firm* — David O. Simmons; IVC Patent Agency

(57) ABSTRACT

A bipod kit for a firearm has a bipod leg mounting body and a firearm structural component. The bipod leg mounting body has a substantially round central passage defining an interior side surface thereof and has two leg mounting structures on an exterior side surface thereof generally opposite the interior side surface. The firearm structural component can be mounted on the firearm at an OEM (original equipment manufacturer) mounting structure thereof. The firearm structural component includes a bipod mounting portion integral therewith. The bipod mounting portion is cylindrical and is rotatably mounted within the central passage of the bipod leg mounting body. The bipod mounting portion is configured such that a barrel of the firearm extends through a central passage thereof when the firearm structural component is mounted on the firearm at the OEM mounting structure thereof.

8 Claims, 5 Drawing Sheets

BIPOD LEG MOUNTING BODY AND BIPOD COMPRISING SAME

CROSS REFERENCE TO RELATED APPLICATIONS

This continuation patent application claims priority from co-pending U.S. Non-Provisional patent application having Ser. No. 13/784,773 that was filed Mar. 4, 2013 and that is entitled "BIPOD LEG MOUNTING BODY AND BIPOD COMPRISING SAME". U.S. Non-Provisional patent application having Ser. No. 13/784,773 is a continuation-in-part patent application that claims priority from U.S. Non-Provisional patent application having Ser. No. 12/930,574, that was filed Jan. 11, 2011, and that is entitled "BIPOD LEG MOUNTING BODY AND BIPOD COMPRISING SAME", which is now U.S. Pat. No. 8,443,540. These applications have a common inventor therewith and are being incorporated herein in their entirety by reference.

FIELD OF THE DISCLOSURE

The disclosures made herein relate generally to firearm accessories and, more particularly, to a bipod having a mounting ring to which a firearm is rotatably mounted.

BACKGROUND

A bipod is an essential asset to many shooters. It provides them with a solid platform for making accurate shots from a prone shooting position. To this end, in most cases, a shooter will configure his or her bipod for their particular prone shooting position. This will typically include setting legs of the bipod to a length corresponding to their prone shooting position.

One drawback of conventional bipods is that they offer no means for readily accommodating uneven surfaces upon which the legs of the bipod might come to rest when a shooter sets up in their prone shooting position. For example, with the bipod legs having been pre-set by the shooter for a level shooting surface, the shooter will find that their firearm is not in a preferred shooting position when one leg of the bipod comes to rest on an obstruction such as a rock or within a depression. In many situations (e.g., a hostile environment), it is not practical or possible for the shooter to re-position the bipod or reconfigure the bipod (e.g., adjust leg length) so as to achieve a bipod orientation that puts their firearm in a preferred shooting position.

Therefore, a bipod configured in a manner that overcomes drawbacks associated with conventional bipods would be advantageous, desirable and useful.

SUMMARY OF THE DISCLOSURE

Embodiments of the present invention relate to a bipod (i.e., a bipod) configured in a manner that overcomes drawbacks associated with conventional bipods. Unlike conventional bipods, a bipod configured in accordance with present invention overcomes provides a means for readily accommodating uneven surfaces upon which the legs of the bipod might come to rest when a shooter sets up in their prone shooting position. For example, with the bipod legs having been pre-set by the shooter for a level shooting surface, a bipod configured in accordance with the present invention allows for the firearm to be rotated about an axis extending parallel to a longitudinal axis of the barrel of the firearm. In this manner, when one leg of the bipod comes to rest on an obstruction such as a rock or within a depression, the shooter will be able to rotate the firearm to position the firearm in a preferred shooting position. As such, with a bipod configured in accordance with the present invention, it is readily possible for the shooter to rotationally reposition the firearm with respect to the bipod so as to put the firearm in a preferred shooting position.

In one embodiment of the present invention, a bipod for a firearm comprises a mounting body assembly, two legs, leg positioning mechanisms and a firearm attachment structure. The mounting body assembly has a first mounting body and a second mounting body. A first mounting body interfacing portion of the second mounting body is engaged within a central passage of the first mounting body in a manner enabling relative rotation therebetween about a centerline longitudinal axis of the central passage. The two legs each have a first end portion and a second end portion. Each one of the legs is rotatably attached at the first end portion thereof to an exterior surface of the first mounting body. One of the leg positioning mechanisms is provided between a respective one of the legs and the first mounting body. Each one of the leg positioning mechanisms enables a respective one of the legs to be selectively secured in a plurality of different discrete rotational positions. The firearm attachment structure is attached to an interior surface of the second mounting body. The firearm attachment structure includes a nose portion protruding from within the second mounting body, wherein the nose portion includes a main body configured for being engaged with a mating portion of a firearm mount.

In another embodiment of the present invention, a bipod for a firearm comprises a first mounting body, a second mounting body, two legs, and leg positioning mechanisms. The first mounting body has two leg mounting structures integral with an exterior surface thereof and having a central passage extending therethrough. The central passage is substantially round. The second mounting body has a cylindrically-shaped portion thereof mounted within the central passage of the first mounting body for enabling the second mounting body to be rotated with respect to the first mounting body about a centerline longitudinal axis of the central passage. The second mounting body has a passage extending therethrough and has a firearm attachment structure attached thereto within the passage thereof. The two legs each have a first end portion and a second end portion. Each one of the legs is attached at the first end portion thereof to a respective one of the leg mounting structures via a leg retaining member extending from a front face of the respective one of the leg mounting structures through an aperture in the corresponding one of the legs. One of the leg positioning mechanism is provided between a respective one of the legs and a respective one of the leg mounting structures. Each one of the leg positioning mechanisms enables the respective one of the legs to be selectively secured in a plurality of different discrete rotational positions and inhibits unrestricted rotation of each one of the legs about the leg rotational axis thereof. The firearm attachment structure includes a nose portion protruding from within the cylindrically-shaped portion of the second mounting body.

In another embodiment of the present invention, bipod for a firearm comprises a first mounting body, a second mounting body, two legs, and leg positioning mechanisms. The first mounting body has two leg mounting structures integral with an exterior surface thereof and having a central passage extending therethrough. Each one of the leg mounting structures has a plurality of leg positioning features within a side surface thereof. The second mounting body has a cylindrically-shaped portion thereof rotatably mounted within central passage of the first mounting body. The second mounting body has a passage extending therethrough and has a firearm attachment structure attached thereto within the passage thereof. The firearm attachment structure includes a nose portion protruding from within the cylindrically-shaped portion of the second mounting body. The two legs each have a first end portion and a second end portion. Each one of the legs is attached at the first end portion thereof to a respective one of the leg mounting structures via a leg retaining member extending from a front face of the respective one of the leg mounting structures through a slot in the corresponding one of the legs. A leg rotational axis of each one of the legs is defined by the leg retaining member associated therewith. One of the leg positioning mechanism is provided between a respective one of the legs and a respective one of the leg mounting structures.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
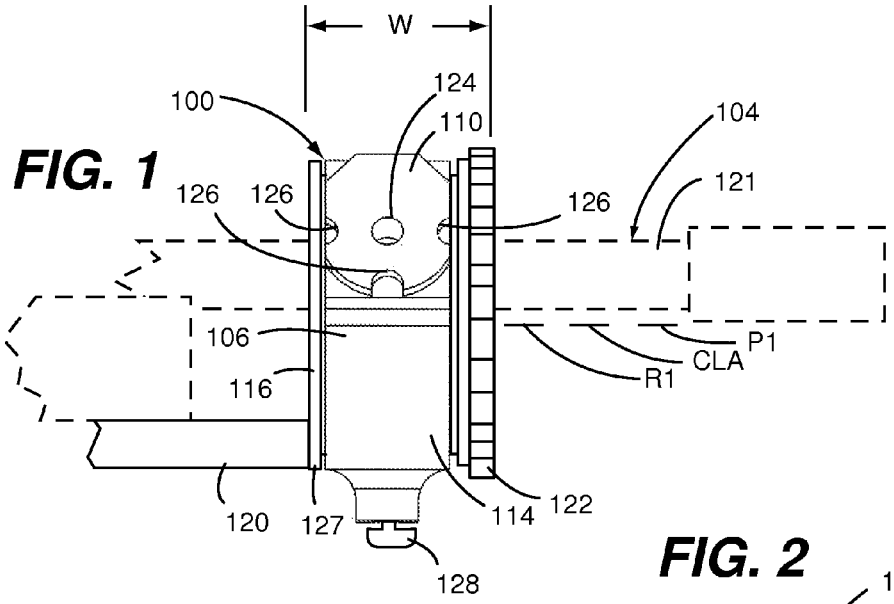
FIG. 1 is a side view of a bipod configured in accordance with the present invention.
Figure 2:
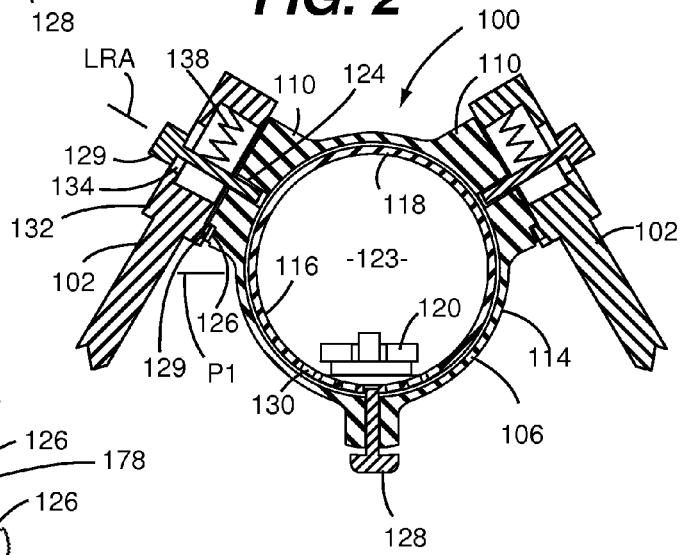
FIG. 2 is a cross-sectional view taken along the line 2-2 in FIG. 1.

FIGS. 1, 1A, 1B and 2 show a bipod 100 configured in accordance with an embodiment of the present invention. In FIG. 1, legs 102 of the bipod 100 are omitted for clarity. In FIG. 2, a firearm 104 attached to the bipod 100 in FIG. 1 is omitted for clarity. The bipod 100 is configured for accommodating uneven surfaces upon which legs 102 of the bipod 100 might come to rest when a shooter sets up in their prone shooting position to shoot a firearm 104 attached to the firearm 104. For example, with the legs 102 having been pre-set (e.g., to a prescribed length) by the shooter for a level shooting surface, the bipod 100 allows for a firearm 104 attached to the bipod 100 to be rotated about an axis extending parallel to a longitudinal axis of the barrel of the firearm 104. In this manner, when one or both of the legs 102 comes to rest on an obstruction or within a depression such that the firearm 104 is not in the shooter's preferred shotting position, the bipod 100 allows the shooter to rotate the firearm 104 to a position in which the firearm 104 in a preferred shooting position. As such, with a bipod configured in accordance with the present invention, it is readily possible for the shooter to quickly and simply rotationally reposition a firearm with respect to legs of the bipod so as to put the firearm in the preferred shooting position.

Figure 3:
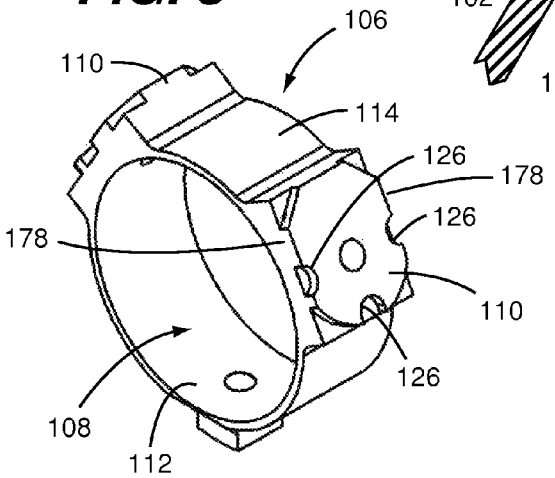
FIG. 3 is a perspective view showing a bipod ring of the bipod of FIG. 1.

Referring to FIGS. 1-3, a bipod leg mounting body 106 (i.e., a first mounting body) of the bipod 100 has a central passage 108 (FIG. 3) and two leg mounting structures 110. The central passage 108 is preferably substantially round and defines an interior side surface 112 (FIG. 3) of the bipod leg mounting body 106. The leg mounting structures 110 extend from an exterior side surface 114 of the bipod leg mounting body 106. The exterior side surface 114 is generally opposite the interior side surface 112. Preferably, the exterior side surface 114 extends generally parallel to the interior side surface 112 such that the bipod leg mounting body 106 is generally cylindrical and is thus also referred herein to as a bipod ring. The leg mounting structures 110 extend outwardly from the exterior side surface 114 of the bipod leg mounting body 106.

Referring to FIGS. 1, 1A, 1B and 2, a firearm mounting body 116 (i.e., a second mounting body) of the bipod 100 has a cylindrical portion 118 and a firearm attachment structure 120 attached to the cylindrical portion 118. The cylindrical portion 118 is rotatably mounted within the central passage 108 of the bipod leg mounting body 106 such that a rotational axis R1 of the cylindrical portion 118 with respect to the bipod leg mounting body 106 extends along a centerline longitudinal axis CLA of the central passage 108 of the bipod leg mounting body 106. The firearm mounting body 116 is configured such that a barrel 121 (FIG. 1) of the firearm 104 extends through a central passage 123 of the cylindrical portion 118 when the firearm attachment structure 120 is attached to the firearm 104. As shown, the interior side surface 112 of the bipod leg mounting body 106 and a mating exterior surface 125 of the cylindrical portion 118 are both substantially smooth. Alternatively, the interior side surface 112 of the bipod leg mounting body 106 or the exterior surface 125 of the cylindrical portion 118 can have a plurality of protrusions (e.g., ribs or detents) so as to reduce the potential for adverse affect of contaminants within the sliding interface between the bipod leg mounting body 106 and the cylindrical portion 118. It is also contemplated herein that a bearing or bushing can be provided between the bipod leg mounting body 106 and the cylindrical portion 118 for affecting rotation therebetween.

The cylindrical portion 118 is retained within the central passage 108 by any suitable means for retention that allows rotation of the cylindrical portion 118 with respect to the bipod leg mounting body 106. As shown in FIGS. 1, 1A, 1B, and 4, the means for retention can include a shoulder 127 on a first end of the cylindrical portion 118 and a threaded lock ring 122 engaged within mating threads 125 at the second end of the cylindrical portion 118 thereby capturing the bipod leg mounting body 106 between the shoulder 127 and the threaded lock ring 122. In such captured configuration, a first end face of the firearm mounting body 116 abuts an inside face of the shoulder 127 and a second end face of the firearm mounting body 116 abuts an inside face of the threaded lock ring 122. As assembled, the bipod leg mounting body 106, the firearm mounting body 116 and the threaded lock ring 122 jointly define a mounting body assembly. An overall width of the mounting body assembly (i.e., dimension W shown in FIG. 1) is defined by a longitudinal distance between an outside end face of the shoulder 127 of the bipod leg mounting body 106 and an outside end face of the threaded lock ring 122. In an alternate embodiment, the threaded lock ring 122 can be replaced by a c-clip (or other form of clip for use on a cylindrical structure) and the mating threads 125 can be replaced by a groove that receives the c-clip. In another embodiment, the means for retention can include a threaded fastener fixedly engaged with the bipod leg mounting body 106 and extending into a slot within the cylindrical portion 118. In these alternate embodiments, the bipod leg mounting body 106, the firearm mounting body 116 and the clip or fastener used for their coupling would jointly define the mounting body assembly and an overall width of the mounting body assembly is defined by a longitudinal distance between an outside end face of the shoulder 127 of the bipod leg mounting body 106 and an opposing end face of the bipod leg mounting body 106.

The firearm attachment structure 120 is configured for being attached to the firearm 104. It is disclosed herein that the firearm attachment structure 120 can be suitably configured to be attached to a structural component of a firearm such as, for example, the barrel, a receiver, an accessory mounting rail of the like. In this manner, the bipod 100 can be fixedly attached to the firearm 104.

Each one of the leg mounting structures 110 includes a leg retention feature 124 (e.g., a threaded hole) configured for allowing the legs 102 to be attached to the bipod leg mounting body 106. Each leg retention feature 124 is within a front face of the respective one of the leg mounting structures 110 and defines a respective leg rotational axis LRA. Each one of the legs 102 are pivotable about a leg retaining member 129 (e.g., a threaded fasteners such as a screw or shoulder bolt) secured in the leg retention feature 124 of the respective one of the leg mounting structures 110.

Preferably, the leg retention feature 124 of each one of the leg mounting structures 110 lies on the same side of a plane P1 extending through an axis of rotation R1 of the cylindrical portion 118 with respect to the bipod leg mounting body 106. Preferably, the leg mounting structures 110 are an equal distance above the plane P1. Preferably, the leg retention feature 124 of each one of the leg mounting structures 110 is above the plane P1 when ground engaging ends of the legs 102 are engaged with the ground, floor or other similar support surface. Preferably, as shown in FIG. 2, the respective leg rotational axis LRA of each one of the leg mounting structures 110 extends generally perpendicular to the rotational axis R1 of the cylindrical portion 118 and intersect the rotational axis R1 of the cylindrical portion 118 with respect to the bipod leg mounting body 106. It is disclosed herein that the leg rotational axis LRA of the leg mounting structures 110 can intersect each other at a location above the plane P1. Alternatively, the leg retention feature 124 of each one of the leg mounting structures 110 can be diametrically opposed to each other and/or can be below the plane P1 when the bipod leg mounting body 106 is mounted on the firearm 104.

Each leg mounting structures 110 also includes a plurality of recesses 126 (i.e., leg positioning features 126). The recesses 126 are selectively engagable by protrusion 129 (i.e., a mating feature) of a respective one of the legs 102 during rotation of the respective one of the legs 102. For example, the recesses 126 can be positioned for allowing each one of the legs 102 to be secured in any one of a plurality of use (i.e., deployed) positions such as the use position shown in FIGS. 1, 1A, 1B and 2 and to be secured in a stowed position (e.g., rotated 90 degrees aft of the first use position such that the legs extend substantially parallel with the centerline longitudinal axis of the barrel of the firearm).

Figure 5:
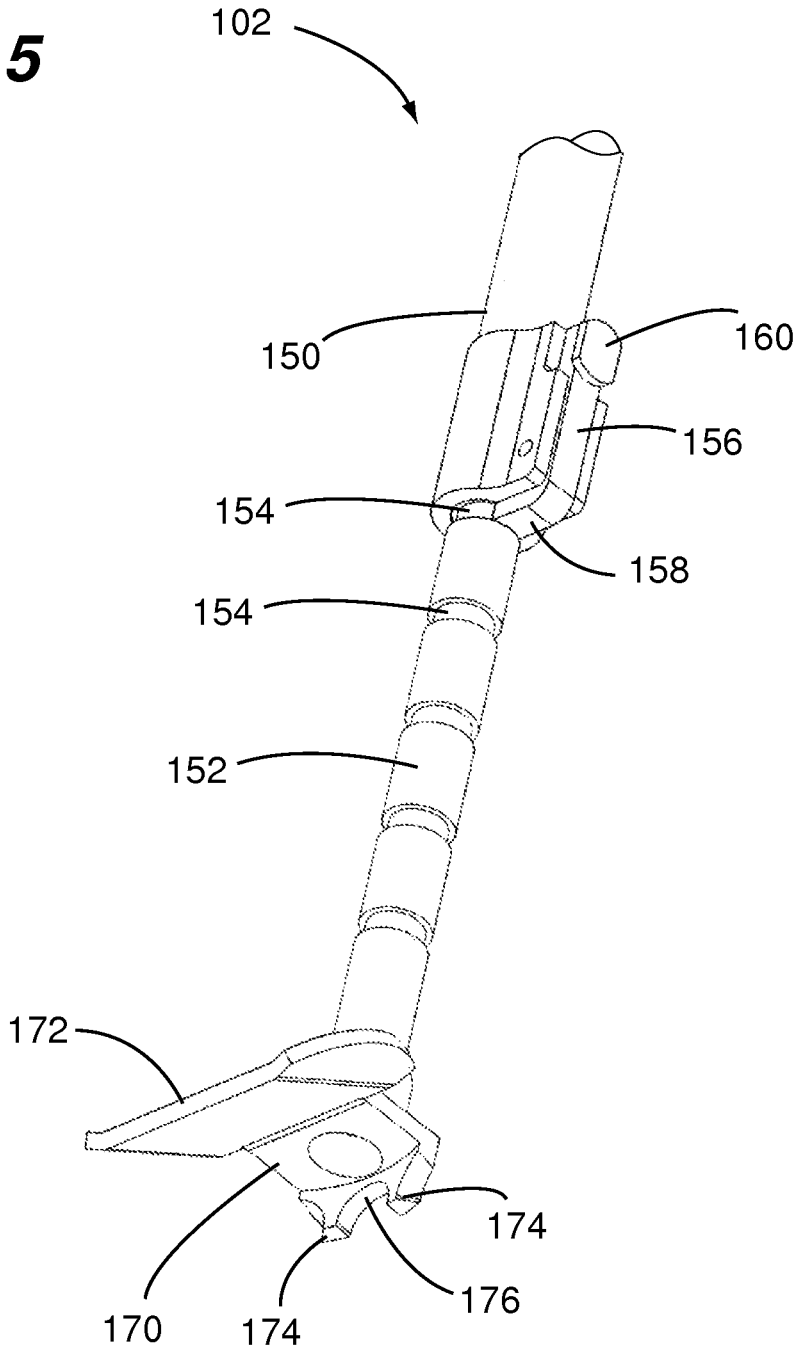
FIG. 5 is a fragmentary view showing a leg of the bipod of FIG. 1 in a partially extended configuration.

As depicted, in FIG. 2, the protrusion 129 can be a lug that is integral (e.g., unitarily formed with) a head portion 132 (i.e., first end portion) of the respective one of the legs 102. The head portion 132 has a slot-shaped passage 134 through which a shank portion 136 of the leg retaining member 129 extends. As shown in FIG. 5, a spring 138 (i.e., a resilient member) biases the respective one of the legs 102 such that the protrusion 129 is engaged within one of the recesses 126 with which the protrusion 129 is aligned. As such, the orientation of the leg is defined by the position of the recess 126 with which the protrusion 129 is aligned and engaged within. As shown in FIG. 5B, through manual application of force on a particular one of the legs 102 against the biasing force of the spring 138, the protrusion 129 becomes disengaged with the recess 126 with which the protrusion 129 is engaged thereby allowing that particular one of the legs 102 to be pivoted to a different position. For example, each one of the legs 102 can be selectively moved between a plurality of different angular positions as defined by the angular orientation of the recesses 126 with respect to the leg retention feature 124 of the respective one of the leg mounting structures 110 (e.g., 0-degrees from vertical, +45/−45 degree from vertical, +90/−90 degree from vertical, etc). The protrusion 129 and the recesses 126 are one example of a leg positioning mechanism that is provided between a leg 102 and a respective one of the leg mounting structures 110. In another embodiment, the slot-shaped passage 134 within each one of the legs 102 is replaced with a round passage and the protrusion 129 of each one of the legs 102 is replaced by a spring-biased ball such that selectively engages an aligned one of the recesses 126 for securing each leg 102 in a position corresponding to the engaged one of the recesses 126.

As disclosed above, the leg retention feature 124 of each one of the leg mounting structures 110 is preferably above the plane P1 when ground engaging ends of the legs 102 are engaged with the ground, floor or other similar support surface. To this end, the recess 126 corresponding to the 90-degree leg position (i.e., position corresponding to the respective leg 102 extending perpendicular to the rotation axis R1) is positioned on a respective one of the leg mounting structures 110 such that the leg retention feature 124 of each one of the leg mounting structures 110 is above the plane P1 when ground engaging ends of the legs 102 are engaged with the ground, floor or other similar support surface. Other ones of the recesses 126 are no farther than about 90 degrees away from the 90-degree leg position. Furthermore, each one of the leg mounting structures 110 and the respective one of the legs 102 can be configured to inhibit the leg 102 from being pivoted more than about 90 degrees away from the 90-degree leg position. For example, side surfaces 178 of the leg mounting structure 110 (shown in FIG. 3) can be configured (e.g., of a suitable length) such that the protrusion 129 (i.e., particular in the case of the protrusion being a lug that is integral the head portion 132 of the respective one of the legs 102) engages the corresponding one of the side surfaces 178 when the leg 102 is sufficient pivoted more than 90 degrees away from the 90-degree leg position (e.g., 95 or 100 degrees away from the 90-degree leg position in either rotational direction). In this regard, the leg 102 has a structural element that engages a mating structural element of the leg mounting structure 110 for to inhibiting the leg 102 from being pivoted more than about 90 degrees away from the 90-degree leg position. The can also be visualized as a position more than about 90-degrees away from a position in which a leg is substantially perpendicular to the centerline longitudinal axis CLA of the central passage 108 (e.g., as defined by a straight line extending between the respective leg rotational axis LRA and a portion of the leg that is intended to contact the ground when the bipod 100 is in upright use).

The bipod leg mounting body 106 and the firearm mounting body 116 can be jointly configured for allowing the firearm mounting body 116 to be secured in a prescribed rotational position with respect to the bipod leg mounting body 106. For example, as shown in FIG. 2, a locking member 128 engaged with the bipod leg mounting body 106 can extend into one of a plurality of spaced part apertures 130 in the cylindrical portion 118. In this manner, an angular orientation of the firearm mounting body 116 with respect to the bipod leg mounting body 106 can be selectively fixed.

Figure 1A:
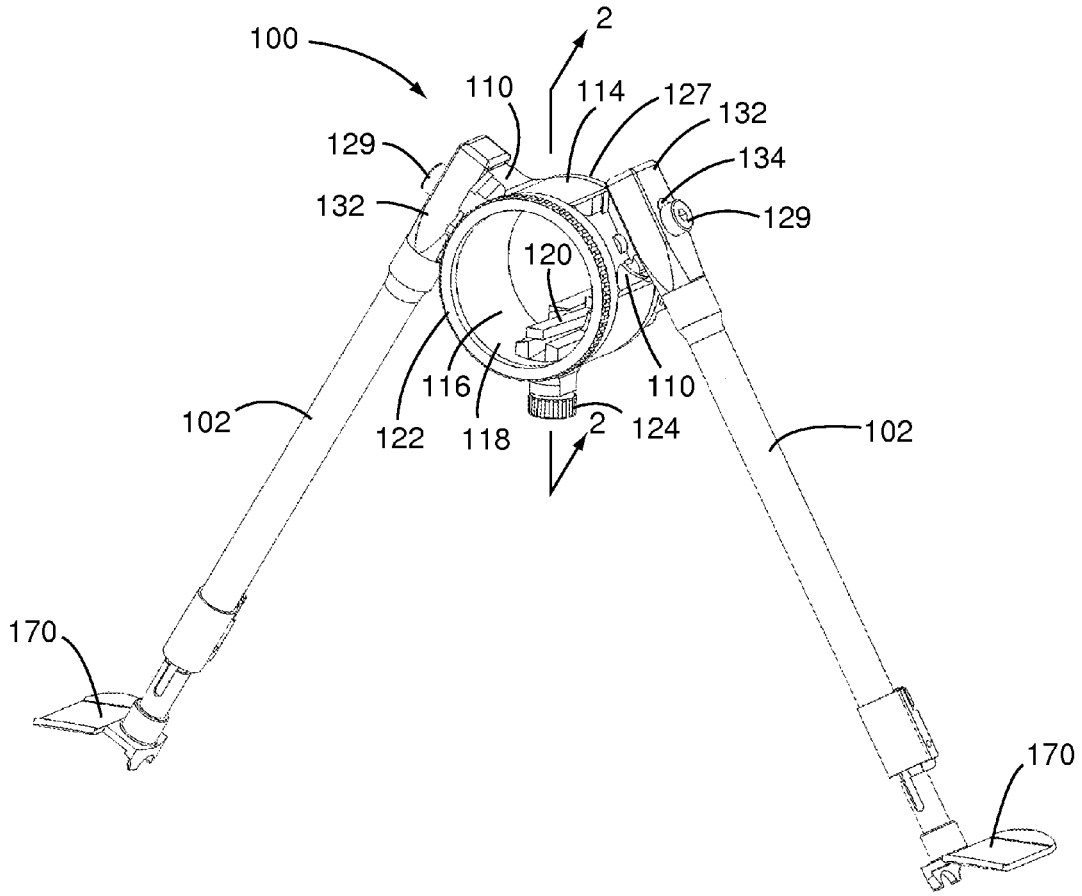
FIG. 1A is a first perspective view showing the bipod of FIG. 1.
Figure 1B:
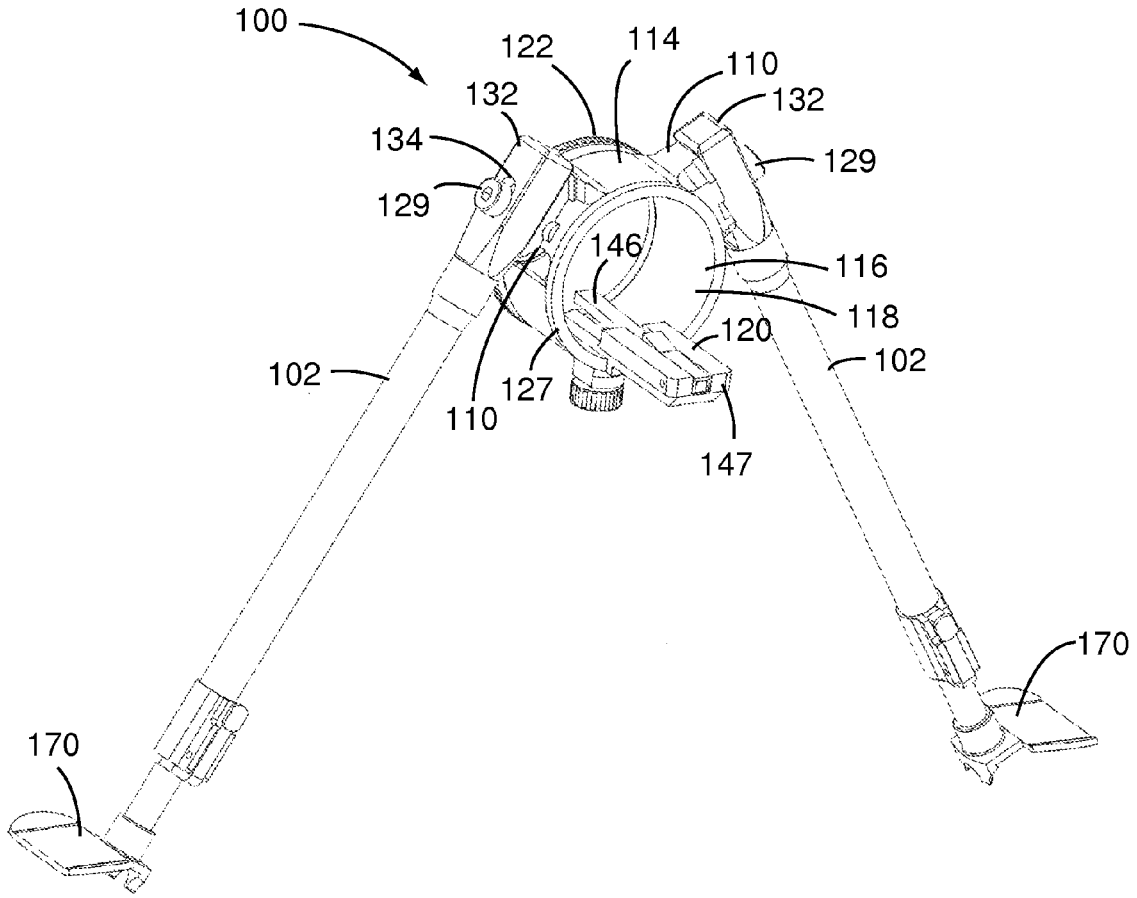
FIG. 1B is a second perspective view showing the bipod of FIG. 1.
Figure 4:
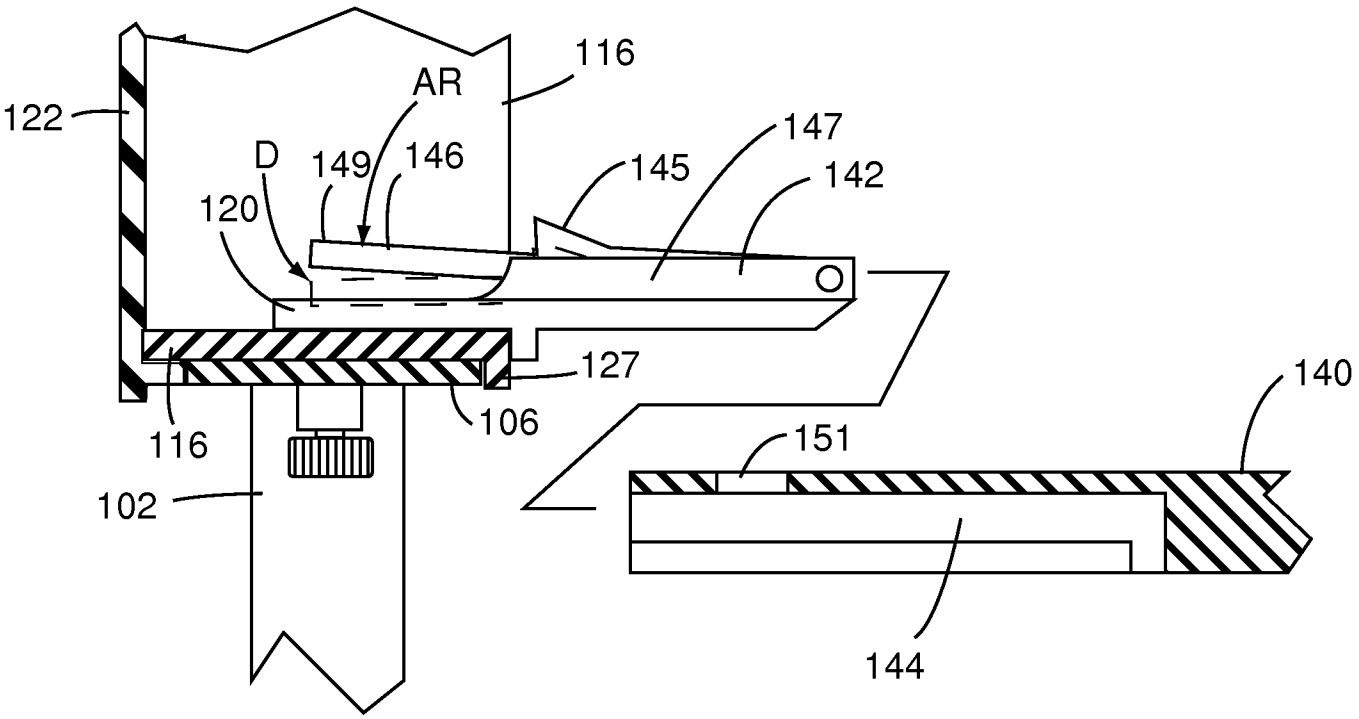
FIG. 4 is a fragmentary cross-sectional view showing a firearm attachment portion of the bipod of FIG. 1 in relation to a firearm mount, which is taken along a centerline of the firearm mount and along a face of the firearm attachment portion.

Referring to FIGS. 1B and 4, the firearm attachment structure 120 of the firearm mounting body 116 is configured to be engaged with a firearm mount 140. The firearm mount 140 can be a discrete structure attachable to a firearm or a structure that is an integral (e.g., unitary formed) portion of a structure of a firearm. In the depicted embodiment, the firearm attachment structure 120 includes a nose portion 142. The nose portion 142 includes a main body 147 configured for being engaged within a channel 144 of the firearm mount 140 and a retention member 146 configured for being engaged with a mating portion of the firearm mount firearm 140 for inhibiting unintentional disengagement of the firearm mount 140 from the firearm attachment structure 120. The channel 144 is exposed at a first end portion of the firearm mount 140 and a firearm engagement portion can be at a second end portion of the firearm mount 140 or other region of the firearm mount 140. The nose portion 142 and the channel 144 can both have a T-shaped cross-sectional profile that enables the nose portion 142 to translate along a length of the channel 144 while translation and rotation in other directions is substantially constrained (i.e., functionally insignificant translation and rotation in such other directions). Upon a sufficient amount of insertion of the nose portion 142 into the channel 144, an engagement portion 145 (e.g., a protrusion) of a retention member 146 (e.g., a lever) of the firearm attachment structure 120 engages a mating retention structure 151 (e.g., hole or recess) of the firearm mount 140. The retention member 146 of the firearm attachment structure 120 is biased to an at-rest position AR (shown in FIG. 4) and is manually moveable to a displaced position D such as by depressing a control portion 149 of the retention member 146. In this manner, the retention member 146 of the firearm attachment structure 120 can be moved toward the displaced position for causing the engagement portion 145 of the retention member 146 to become disengaged from the mating retention structure 151 of the firearm mount 140 thereby allowing the nose portion 142 to be retracted from within the channel 144.

Referring not to FIG. 5, length adjustability of the legs 102 is discussed in greater detail. Each leg 102 includes an upper leg structure 150 and a lower leg structure 152. The upper leg structure 150 is the portion of each leg 102 that is pivotably attached to the bipod leg mounting body 106. The lower leg structure 152 is mounted on the upper leg structure 150 in a manner allowing the lower leg structure 152 to be longitudinally extended and retracted with respect to the upper leg structure 150. As depicted, the lower leg structure 152 is slideably disposed within a central passage of the upper leg structure 150. The lower leg structure 152 includes a plurality of spaced apart grooves 154 (i.e., positioning structures) that can be individually and selectively engaged by a length adjustment device 156 (i.e., a lever) of the upper leg structure 150. Indicial such as numbers, letters or other configuration of symbols can be provided on (e.g., embossed within, printed on, etc) the lower leg structure 152 between the adjacent ones of the grooves for aiding in setting a desired length of the respective one of the legs 102. For example, the indicia can be used for setting a desired length of one of the legs 102 with respect to the other one of the legs 102. The length adjustment device 156 has a groove engaging portion 158 and a release portion 160. The length adjustment device 156 is pivotably attached to the upper leg structure 150 and is spring biased such that the groove engaging portion 158 is urged against the lower leg structure 152. In this manner, the groove engaging portion 158 of the length adjustment device 156 can be secured in one of the grooves 154 for securing the lower leg structure 152 in a fixed longitudinal position with respect to the upper leg structure 150. By depressing the release portion 160 of the length adjustment device 156, the groove engaging portion 158 becomes disengaged from the engaged one of the grooves 154 for allowing the lower leg structure 152 to be moved to a different longitudinal position (i.e., longitudinally adjusted) with respect to the upper leg structure 150.

Each one of the legs 102 includes a foot structure 170 at a distal end 171 of the leg 102 (i.e., the end of the leg opposite the upper leg structure 150). The foot structure 170 is preferably configured for providing support functionality on a variety of different surfaces. A large area support pad 172, which can extend substantially laterally with respect to the distal end 171 of the leg 102, provides for support on compactable surfaces such as sand, dirt and the like and can be used to engage an overhead support structure (e.g., a rafter) when the bipod 100 is used in an inverted orientation (i.e., legs 102 extending in an upward direction with respect to the bipod leg mounting body 106). Prongs 174, which can extends substantially longitudinally with respect to the leg 102, provide for engagement in substantially solid support surfaces (e.g., via piercing engagement) such as for example, stone, concrete, metal, compacted earth or the like. A geometrically shaped recess 176 (e.g., an arcuate such as a semi-circle, V-shaped groove, etc), which can be located between the prongs 174 and which can extends substantially longitudinally with respect to the leg 102, provide for engagement with a contoured surface and/or edge.

In one embodiment of the present invention, the bipod is provided in the form of a kit. The kit includes the bipod 100 and the firearm mount 140. Preferably, the firearm mount 140 is mountable on a firearm at an OEM (original equipment manufacturer) mounting structure (e.g., a barrel, receiver, accessory mounting rail, handgrip, etc). Preferably, firearm mount 140 is configured such that the barrel 121 of the firearm 104 extends through the central passage 108 when the firearm mount 140 is mounted on the firearm 104 at the OEM mounting structure thereof. It is disclosed herein that the firearm mount 140 can be an integral element of a firearm (e.g., unitarily formed with a receiver, handguard or flash arrester thereof).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bipod for a firearm, comprising:

a mounting body assembly having a first mounting body and a second mounting body, wherein a first mounting body interfacing portion of the second mounting body is engaged within a central passage of the first mounting body in a manner enabling relative rotation therebetween about a centerline longitudinal axis of the central passage;

two legs each having a first end portion and a second end portion, wherein each one of the legs is rotatably attached at the first end portion thereof to an exterior surface of the first mounting body;

a plurality of leg positioning mechanisms, wherein one of the leg positioning mechanisms is provided between a respective one of the legs and the first mounting body, wherein each one of the leg positioning mechanisms enables the respective one of the legs to be selectively secured in a plurality of different discrete rotational positions; and a firearm attachment structure attached to the second mounting body, wherein the firearm attachment structure includes a nose portion protruding from within a central passage of the second mounting body, wherein the nose portion includes a main body configured for being engaged with a mating portion of a firearm mount and wherein the nose portion of the firearm attachment structure has a T-shaped cross-sectional profile;

wherein each one of the legs is attached at the first end portion thereof to first mounting body via a respective leg retaining member extending from an exterior surface of first mounting body through an aperture in the corresponding one of the legs;

wherein the leg positioning mechanism of each one of the legs includes a plurality of leg positioning features spaced around the respective leg retaining member;

wherein each one of the leg positioning mechanisms includes a resilient member positioned between the respective one of the legs and the respective leg retaining member; and wherein the resilient member axially biases the respective one of the legs such that a leg positioning structure of the respective one of the legs is urged in a direction extending substantially parallel to a longitudinal axis of the respective one of the legs into engagement with a mating structure of the first mounting body for allowing the respective one of the legs to be secured in rotational positions as defined by the leg positioning features surrounding the respective leg retaining member.

2. The bipod of claim 1, further comprising:

a threaded lock ring engaged with mating threads at a first end portion of the first mounting body interfacing portion of the second mounting body, wherein a shoulder is provided at a second end portion of the first mounting body interfacing portion of the second mounting body such that the first mounting body is captured between the threaded lock ring and the shoulder.

3. A bipod for a firearm, comprising:

a mounting body assembly having a first mounting body and a second mounting body, wherein a first mounting body interfacing portion of the second mounting body is engaged within a central passage of the first mounting body in a manner enabling relative rotation therebetween about a centerline longitudinal axis of the central passage;

two legs each having a first end portion and a second end portion, wherein each one of the legs is rotatably attached at the first end portion thereof to an exterior surface of the first mounting body;

a plurality of leg positioning mechanisms, wherein one of the leg positioning mechanisms is provided between a respective one of the legs and the first mounting body, wherein each one of the leg positioning mechanisms enables the respective one of the legs to be selectively secured in a plurality of different discrete rotational positions; and a firearm attachment structure attached to the second mounting body, wherein the firearm attachment structure includes a nose portion protruding from within a central passage of the second mounting body, wherein the nose portion includes a main body configured for being engaged with a mating portion of a firearm mount; wherein the nose portion of the firearm attachment structure has a T-shaped cross-sectional profile.

4. The bipod of claim 3, further comprising:

a threaded lock ring engaged with mating threads at a first end portion of the first mounting body interfacing portion of the second mounting body, wherein a shoulder is provided at a second end portion of the first mounting body interfacing portion of the second mounting body such that the first mounting body is captured between the threaded lock ring and the shoulder.

5. A bipod for a firearm, comprising:

a first mounting body having two leg mounting structures integral with an exterior surface thereof and having a central passage extending therethrough;

a second mounting body having a cylindrically-shaped portion thereof mounted within the central passage of the first mounting body for enabling the second mounting body to be rotated with respect to the first mounting body about a centerline longitudinal axis of the central passage, wherein the second mounting body has a central passage extending therethrough and has a firearm attachment structure attached thereto within the central passage thereof, wherein the firearm attachment structure includes a nose portion protruding from within a central passage of the second mounting body, wherein the nose portion includes a main body configured for being engaged with a mating portion of a firearm mount, and wherein the nose portion of the firearm attachment structure has a T-shaped cross-sectional profile;

two legs each having a first end portion and a second end portion, wherein each one of the legs is attached at the first end portion thereof to a respective one of the leg mounting structures via a leg retaining member extending from a front face of the respective one of the leg mounting structures through an aperture in the corresponding one of the legs;

a plurality of leg positioning mechanisms, wherein one of the leg positioning mechanisms is provided between a respective one of the legs and a respective one of the leg mounting structures, wherein each one of the leg positioning mechanisms enables the respective one of the legs to be selectively secured in a plurality of different discrete rotational positions and inhibits unrestricted rotation of the respective one of the legs about the leg rotational axis thereof; and a threaded lock ring engaged with mating threads at a first end portion of the cylindrically-shaped portion of the second mounting body, wherein a shoulder is provided at a second end portion of the cylindrically-shaped portion of the second mounting body such that the first mounting body is captured between the threaded lock ring and the shoulder;

wherein each one of the leg positioning mechanisms includes a plurality of leg positioning features spaced around the respective one of the leg retaining members;

wherein each one of the leg positioning mechanisms includes a resilient member positioned between the respective one of the legs and the respective one of the leg retaining members; and wherein the resilient member axially biases a respective one of the legs such that a leg positioning structure of the respective one of the legs is urged in a direction extending substantially parallel to a longitudinal axis of the respective one of the legs into engagement with a mating structure of the first mounting body for allowing the respective one of the legs to be secured in rotational positions as defined by the leg positioning features surrounding the respective one of the leg retaining members.

6. A bipod for a firearm, comprising:

a first mounting body having two leg mounting structures integral with an exterior surface thereof and having a central passage extending therethrough;

a second mounting body having a cylindrically-shaped portion thereof mounted within the central passage of the first mounting body for enabling the second mounting body to be rotated with respect to the first mounting body about a centerline longitudinal axis of the central passage, wherein the second mounting body has a central passage extending therethrough and has a firearm attachment structure attached thereto within the central passage thereof, wherein the firearm attachment structure includes a nose portion protruding from within a central passage of the second mounting body, wherein the nose portion includes a main body configured for being engaged with a mating portion of a firearm mount, and wherein the nose portion of the firearm attachment structure has a T-shaped cross-sectional profile;

two legs each having a first end portion and a second end portion, wherein each one of the legs is attached at the first end portion thereof to a respective one of the leg mounting structures via a leg retaining member extending from a front face of the respective one of the leg mounting structures through an aperture in the corresponding one of the legs;

a plurality of leg positioning mechanisms, wherein one of the leg positioning mechanisms is provided between a respective one of the legs and a respective one of the leg mounting structures, wherein each one of the leg positioning mechanisms enables the respective one of the legs to be selectively secured in a plurality of different discrete rotational positions and inhibits unrestricted rotation of the respective one of the legs about the leg rotational axis thereof; and a threaded lock ring engaged with mating threads at a first end portion of the cylindrically-shaped portion of the second mounting body, wherein a shoulder is provided at a second end portion of the cylindrically-shaped portion of the second mounting body such that the first mounting body is captured between the threaded lock ring and the shoulder.

7. A bipod for a firearm, comprising:

a first mounting body having two leg mounting structures integral with an exterior surface thereof and having a central passage extending therethrough, wherein each one of the leg mounting structures has a plurality of leg positioning features within a side surface thereof;

a second mounting body having a cylindrically-shaped portion thereof rotatably mounted within central passage of the first mounting body, wherein the second mounting body has a central passage extending therethrough and has a firearm attachment structure attached thereto within the passage thereof, wherein the firearm attachment structure includes a nose portion protruding from within the central passage of the second mounting body, and wherein the nose portion of the firearm attachment structure has a T-shaped cross-sectional profile;

two legs each having a first end portion and a second end portion, wherein each one of the legs is attached at the first end portion thereof to a respective one of the leg mounting structures via a leg retaining member extending from a front face of the respective one of the leg mounting structures through an elongated passage in the corresponding one of the legs, wherein a leg rotational axis of each one of the legs is defined by the leg retaining member associated therewith; and a leg positioning mechanism provided between a respective one of the legs and a respective one of the leg mounting structures, wherein the respective one of the legs, the respective one of the leg mounting structures and the leg positioning mechanism provided therebetween are jointly configured for enabling axial translation of the respective one of the legs between a first position that inhibits rotation of the respective one of the legs about a rotational axis thereof and a second position that allows rotation of the respective one of the legs about the rotational axis thereof, wherein each one of the leg positioning mechanisms includes a plurality of leg positioning features spaced around the respective one of the leg retaining members, wherein each one of the leg positioning mechanisms includes a resilient member positioned between the respective one of the legs and the respective one of the leg retaining members, and wherein the resilient member axially biases a respective one of the legs such that a leg positioning structure of the respective one of the legs is urged in a direction extending substantially parallel to a longitudinal axis of the respective one of the legs into engagement with a mating structure of the first mounting body for allowing the respective one of the legs to be secured in rotational positions as defined by the leg positioning features surrounding the respective one of the leg retaining members.

8. The bipod of claim 7, further comprising:

a threaded lock ring engaged with mating threads at a first end portion of the cylindrically-shaped portion of the second mounting body, wherein a shoulder is provided at a second end portion of the cylindrically-shaped portion of the second mounting body such that the first mounting body is captured between the threaded lock ring and the shoulder.

* * * * *